US010739108B1

(12) United States Patent
Kraft

(10) Patent No.: US 10,739,108 B1
(45) Date of Patent: Aug. 11, 2020

(54) SYSTEMS AND METHODS FOR STABILIZING FIREARMS

(71) Applicant: WARD KRAFT, INC., Fort Scott, KS (US)

(72) Inventor: Ryan Kraft, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 0 days.

(21) Appl. No.: 16/437,954

(22) Filed: Jun. 11, 2019

Related U.S. Application Data

(60) Provisional application No. 62/683,139, filed on Jun. 11, 2018.

(51) Int. Cl.

| | |
|---|---|
| ***F41C 23/12*** | (2006.01) |
| ***F41C 23/16*** | (2006.01) |
| ***F41C 23/14*** | (2006.01) |
| ***F41C 23/22*** | (2006.01) |

(52) U.S. Cl.
CPC ..... *F41C 23/16* (2013.01); *F41C 23/14* (2013.01); *F41C 23/22* (2013.01)

(58) Field of Classification Search
CPC ..... F41C 23/10; F41C 23/12; F41C 23/06
USPC ..... 42/71.01, 73, 72, 71.02, 75.03
See application file for complete search history.

(56) References Cited

U.S. PATENT DOCUMENTS

| | | | | | |
|---|---|---|---|---|---|
| 1,560,840 | A * | 11/1925 | Milloy | F41C 23/00 | 42/71.01 |
| 3,162,966 | A * | 12/1964 | La Coss | F41C 23/12 | 42/72 |
| 3,739,515 | A * | 6/1973 | Koon, Jr. | F41C 23/00 | 42/75.03 |
| 3,742,635 | A * | 7/1973 | Hutto | F41A 13/02 | 42/106 |
| 8,671,608 | B2 * | 3/2014 | Vesligaj | F41C 23/04 | 42/73 |
| 9,664,477 | B1 * | 5/2017 | Reavis, III | F41C 27/22 | |
| 10,180,302 | B2 * | 1/2019 | Reavis, III | F41C 27/22 | |
| D854,110 | S * | 7/2019 | Reavis, III | D22/108 | |
| 10,571,219 | B2 * | 2/2020 | Wilson | F41C 23/12 | |
| 2014/0144061 | A1 * | 5/2014 | Bosco | F41C 33/001 | 42/94 |

* cited by examiner

*Primary Examiner* — Reginald S Tillman, Jr.
(74) *Attorney, Agent, or Firm* — Avant Law Group, LLC

(57) ABSTRACT

A brace for modifying a stock firearm having a straight grip. The brace has an attachment portion configured for the attachment of the brace to the stock firearm. The brace includes a grip portion disposed behind the attachment portion. The grip portion has a top surface and a bottom surface. Each of the bottom surface and the top surface is arced. The bottom surface is configured to be held by a shooter during a shooting operation. The brace includes a bracing portion disposed behind the attachment portion. The bracing portion has at least one slot and a saddle. Each of the at least one slot and the saddle is configured to allow for securement of the brace to a forearm of the shooter while the stock firearm is attached to the attachment portion.

16 Claims, 4 Drawing Sheets

SYSTEMS AND METHODS FOR STABILIZING FIREARMS

RELATED APPLICATIONS

This application claims priority to U.S. Provisional Application No. 62/683,139, filed on Jun. 11, 2018, the disclosure of which is incorporated by reference in its entirety herein.

FIELD OF THE DISCLOSURE

The disclosure relates generally to the field of firearms and attachments therefor. More specifically, the disclosure relates to the field of attachable firearm braces.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In an embodiment, a brace for modifying a stock firearm having a straight grip is disclosed. The brace has an attachment portion configured for the attachment of the brace to the stock firearm. The brace includes a grip portion disposed behind the attachment portion. The grip portion has a top surface and a bottom surface. Each of the bottom surface and the top surface is arced. The bottom surface is configured to be held by a shooter during a shooting operation. The brace includes a bracing portion disposed behind the attachment portion. The bracing portion has at least one slot and a saddle. Each of the at least one slot and the saddle is configured to allow for securement of the brace to a forearm of the shooter while the stock firearm is attached to the attachment portion.

In another embodiment, a method for modifying a stock firearm with a brace is disclosed. The method comprises providing a brace. The brace has an attachment portion configured for the attachment of the brace to the stock firearm. The brace includes a grip portion disposed behind the attachment portion. The grip portion has a top surface and a bottom surface. Each of the bottom surface and the top surface is arced. The bottom surface is configured to be held by a shooter during a shooting operation. The brace includes a bracing portion disposed behind the attachment portion. The bracing portion has at least one slot and a saddle. Each of the at least one slot and the saddle is configured to allow for securement of the brace to a forearm of the shooter while the stock firearm is attached to the attachment portion. The method includes the step of removably securing the attachment portion to the stock firearm.

In yet another embodiment, a brace for modifying a firearm having a straight grip is disclosed. The brace has an attachment portion configured for the attachment of the brace to the firearm. The brace includes a grip portion disposed behind the attachment portion. The grip portion has a top surface and a bottom surface. Each of the bottom surface and the top surface is arced. The bottom surface is configured to be held by a shooter during a shooting operation. The firearm brace has a bracing portion disposed behind the attachment portion. The bracing portion has at least one slot and a saddle. Each of the at least one slot and the saddle is configured to allow for securement of the brace to a forearm of the shooter while the firearm is attached to the attachment portion.

BRIEF DESCRIPTION OF THE SEVERAL VIEWS OF THE DRAWINGS

Illustrative embodiments of the present disclosure are described in detail below with reference to the attached drawing figures.

DETAILED DESCRIPTION

Laws applicable to firearms vary from place to place and from one jurisdiction to another. For example, federal laws applicable to a particular firearm may be different from state laws applicable thereto, and the latter may in-turn be different from the laws applicable to that particular firearm in a different state. Such varying laws may apply to the firearm themselves, to the ammunition therefor, and to the aftermarket or other attachments for use therewith.

Firearm braces are known in the art. A firearm brace is coupled to a firearm and the brace may be secured to the forearm of the shooter to stabilize the firearm during operation. In the prior art, the firearm braces are typically employed with firearms having a "pistol grip." The artisan understands that a pistol grip is a grip that protrudes conspicuously beneath the weapon allowing the shooter to hold the firearm (e.g., a rifle, shotgun, etc.) like a pistol. Because the firearm braces are employed in the prior art generally exclusively with pistol grip designs, there are a variety of laws that apply thereto, and as noted, these laws are not necessarily consistent throughout the nation. A user employing a firearm brace with a firearm having a pistol grip may consequently find it cumbersome to navigate the laws applicable to such pistol grip firearms and firearm braces. It may therefore be desirable to have in place firearm braces usable with firearms having grips other than a pistol grip, such as a straight grip. At least some embodiments of the present disclosure may, among other things, provide for such a brace.

Figure 1:
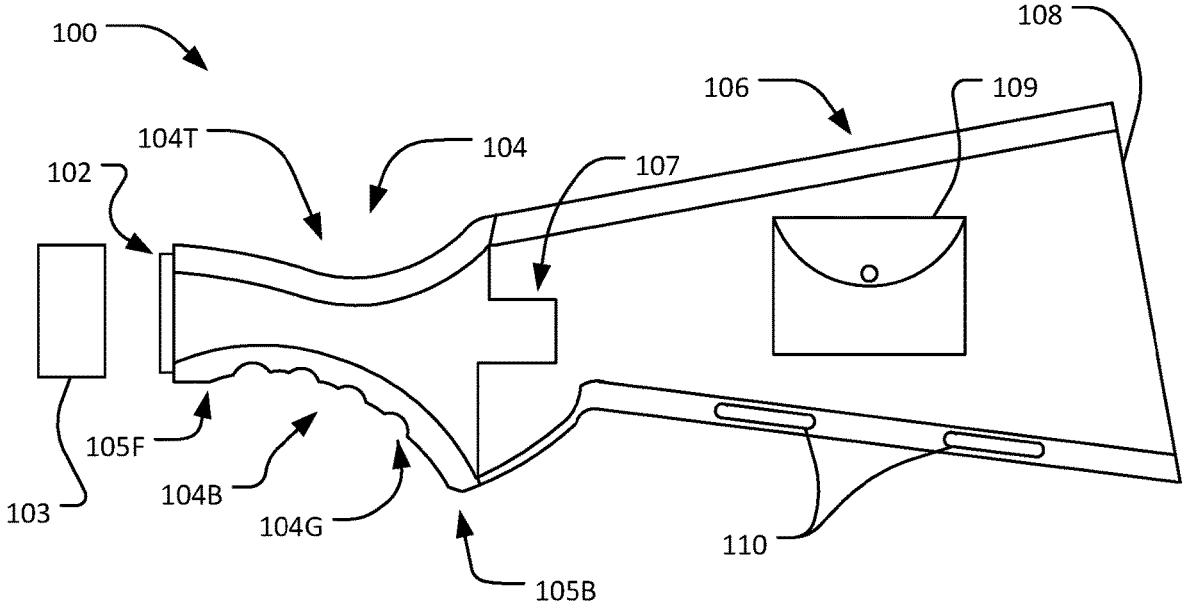
FIG. 1 is a side view of a firearm brace, according to an embodiment of the present disclosure.

Focus is directed now to FIG. 1, which shows a firearm brace 100 according to an embodiment of the present disclosure. The firearm brace 100 may have, at a front end thereof, an attachment area (or portion) 102 which may be configured to couple to a firearm (e.g., a rear portion of a firearm receiver). The firearm to which the brace 100 is coupled (e.g., firearm 201F in FIG. 3) is one that is devoid of a pistol grip and has a grip other than a pistol grip. The grip of the firearm 201F will be identified herein as a straight grip. The phrase "straight grip" refers to traditional straight grips, as are known in the art, and any other grip that is not a pistol grip. The attachment portion 102 may have a coupling structure for attaching (e.g., removably or fixedly) to the firearm, such as apertures for the reception of fasteners (e.g., screws, bolts, keys, tabs, etc.), threads, clips, interlocking components, and/or any other suitable coupling structure. While FIG. 1 depicts the attachment area 102 protruding from the firearm brace 100, a firearm brace 100 having a recessed attachment portion 102 is also contemplated.

It shall be understood that the firearm the firearm brace 100 couples to may have an attachment structure complementary to the attachment portion 102. For example, the firearm may have a recessed portion for the reception of a protruding attachment area 102, a protruding portion for insertion into a recessed attachment area 102, a corresponding set of interlocking components, a quick connect attachment, et cetera. Embodiments of the attachment portion 102 may be specifically configured for use with a particular firearm, such as a certain firearm type or firearm brand.

The attachment portion 102, in embodiments, may be modular (e.g., customizable, adjustable, resizable, etc.) for attachment to a variety of firearms. For instance, the attachment area 102 may have one or more removably couplable devices 103 (as seen detached from the firearm brace 100 in FIG. 1), each of which may be configured to couple the firearm brace 100 with a compatible firearm. The removably couplable devices 103 may be used interchangeably to reconfigure the firearm brace 100 to be compatible with different firearms, such as when the user desires to detach the firearm brace 100 from a first firearm and attach the firearm brace 100 to a second firearm. In this instance, the user may detach a first removably couplable device 103 that is compatible with the first firearm, in order to attach a second removably couplable device 103 that is compatible with the second firearm. While conventional firearm braces are typically compatible with a single type of firearm, a firearm brace 100 with a modular attachment area 102 may be compatible with a plurality of firearms or firearm types.

Figure 2:
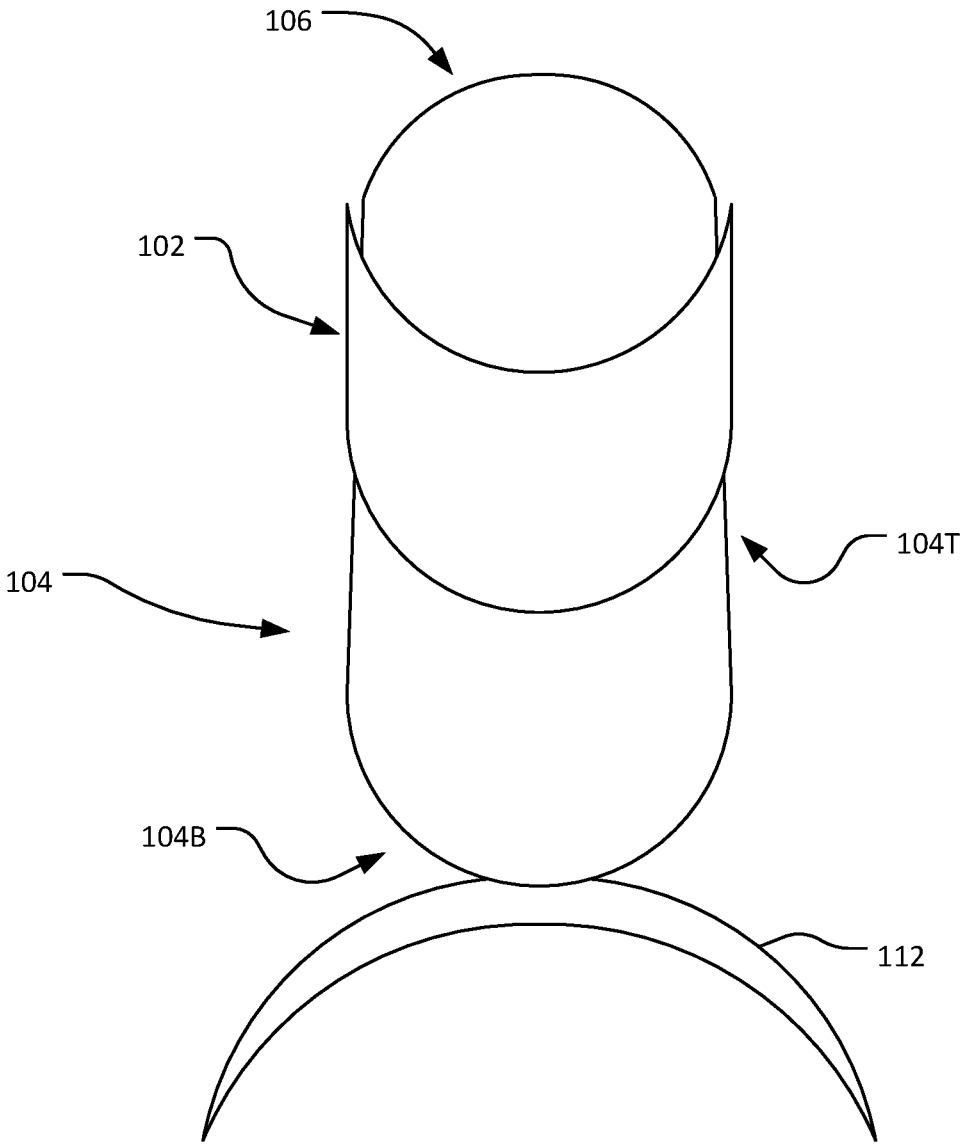
FIG. 2 is a front view of the firearm brace, according to another embodiment of the present disclosure.

In embodiments, such as the embodiment of the firearm brace 100 depicted in FIG. 2, the attachment area 102 may have an over molded construction. In other words, the attachment area 102 may be configured to fit around at least a part of the firearm and thus secure the firearm brace 100 thereto. For instance, attachment area 102 may form a cavity (e.g., a generally U-shaped cavity) to partially or wholly envelop a portion of the firearm, such as a firearm grip. Alternately or additionally, the attachment area 102 may include an over molded construction that may add and/or replace conventional firearm components. For example, the attachment area 102 may have an over molded construction that includes a firearm foregrip. In operation, the attachment area 102 with an over molded construction may allow the firearm brace 100 to couple to a firearm having a straight grip.

The brace 100 may have a grip area (or portion) 104. The grip area 104 may be disposed behind the attachment area 102; that is, the grip area may be further away from the firearm relative to the attachment area 102. The grip area 104 may be used by a user to hold on to the firearm brace 100 and the firearm coupled thereto during a shooting operation (e.g., a hunting activity, a target shooting activity, et cetera). The grip area 104, configured to be comfortably gripped by the user during the shooting operation, may render the provision of a pistol grip unnecessary.

In an embodiment, the grip area 104 may have a top portion 104T and a bottom portion 104B. The grip bottom portion 104B may, in embodiments, be arced (e.g., the grip bottom portion 104B may define a portion of an imaginary circle or an ellipse). The arc forming the grip bottom portion 104B may have a front end 105F and a back end 105B, and as shown in FIG. 1, the back end 105B may be proximate the ground (or other surface) relative to the front end 105F. In embodiments, the top portion 104T may also be curved (e.g., such that its front end may be proximate the ground relative to its back end). While a curved grip 104 is shown in FIG. 1, other grip bottom portion 104B and grip top portion 104T configurations are contemplated in alternate embodiments (e.g., a curved bottom portion 104B with a linear top portion 104T, a linear top portion 104T with a linear bottom portion 104B, an angled top portion 104T and/or bottom portion 104B, et cetera). Alternately or additionally, the grip area 104 may be any other suitable grip type or grip configuration (e.g., pistol grip).

The grip area 104, in embodiments, may have one or more grip grooves 104G for improving the ergonomics of the grip area 104. The grip grooves 104G may be shaped and/or arranged to help retain one or more fingers of user, such as via channels, apertures, recesses, et cetera. Alternately or additionally, the grip grooves 104G may include a groove shaped and/or arranged to help retain a palm of the user. It shall be understood that, in embodiments, the grip grooves 104G may be configured to be used by a user of right hand and/or left hand orientation. In operation, the grip grooves 104G may, among other things, reduce undesirable user hand slippage while gripping the firearm brace 100, provide a more comfortable gripping surface, allow better control of the firearm, et cetera.

The firearm brace 100 may have a brace (also referred to herein as a bracing portion) 106 extending from the grip area 104. While FIG. 1 depicts an example embodiment of a brace 106, it is to be understood that the brace 106 may have any suitable brace configuration, such as a partially or wholly hollowed-out construction, a solid construction, a lightweight frame construction, an adjustable/collapsible construction, a folding construction, et cetera. Different brace 106 configurations may be desirable for different applications. For example, a heavier brace 106 may provide more firearm stability, while a lightweight brace 106 may be easier to transport/carry.

In embodiments, the grip area 104 and/or the brace 106 may include attachment structure 107 for coupling (e.g., removably or fixedly) the grip area 104 to the brace 106. The attachment structure 107 may include components such as apertures for the reception of fasteners (e.g., screws, bolts, keys, tabs, etc.), threads, clips, interlocking parts, and/or any other suitable coupling structure. In operation, the attachment structure 107 may allow for a modular grip area 104 and/or brace 106. For example, a user, having a fire arm brace 100 with a first grip area 104 coupled to a first brace 106, may detach the first brace 106 from the first grip area 104 and attach a second brace 106 to the first grip area 104. Having a modular grip area 104 and/or brace 106 may be advantageous where, for example, a user desires to modify the firearm brace 100 to change its performance properties (e.g., weight, stability, flexibility, ergonomics, environmental resistance, compatibility with certain firearm types, et cetera).

It shall be understood that, in embodiments, the firearm brace 100 may include a plurality of selectably attachable modular grip areas 104 and/or braces 106 which may be interchangeably used to produce a firearm brace 100. Since some of the plurality of modular grip areas 104 and/or braces 106 may have disparate configurations (e.g., a different amount of weight, a different level of ergonomics, etc.), a firearm brace 100 of desirable performance properties may be assembled by swapping out modular grip areas 104/brace 106. Further, modular grip areas 104 and/or braces 106 may be easier and/or less expensive to replace in the case of wear or other degradations. For example, it may be less expensive to replace just a worn brace 106 of the modular firearm brace 100 (and thus retain the still functional grip area 104) then it may be to replace an entire conventional firearm brace that has a similarly worn brace.

The brace 106 may have a brace butt 108 at an end which, during operation, may be abutted against the body of the user to increase the user's control of the firearm. The brace butt 108 may be made of a suitable ergonomic material, such as foam, rubber, a polymer, et cetera. Alternately or additionally, the brace butt 108 may have an ergonomic shape, such as a curved shape (i.e., a curve shaped to comfortably nestle against a user's shoulder).

The brace 106 may include one or more containing portions 109 for holding one or more objects (e.g., ammo, firearm accessories, survival gear, et cetera). The containing portions 109 may be, for example, a pouch, an ammo rack, an aperture, a recess, a selectably openable cavity in the brace 106, a fastener, an adhesive, a hook and loop fastener, et cetera.

In embodiments, the user may secure the brace 100 to his or her shooting arm via the brace 106. For example, the brace 106 may have one or more slots 110 through which the shooter may pass a conventional, or other, strap to secure (e.g., via a buckle, a hook and loop fastener, a clip, etc.) the brace 106 to the user's body. That is, the strap(s) may pass through the slots 110 and around the shooter (e.g., the shooter's forearm), and thereby secure the firearm brace 100 to the shooter during the shooting operation. Securing the firearm brace 100 to the shooter's arm may allow the firearm to rest stably against the shooter's arm, and as such, may increase the shooter's comfort and/or the accuracy of the shooter's shots.

In some embodiments, such as the embodiment depicted in FIG. 2, the brace 106 may alternately or additionally include (e.g., removably or fixedly) a saddle device 112 configured to wrap around some or all of a circumference of an arm of the shooter. The saddle device 112, in some embodiments, may include a fastening mechanism (e.g., a hook and loop fastener, a button, etc.) at one or more ends to further secure the saddle device to the shooter's arm. The saddle device 112 may allow the shooter to brace the firearm against the shooter's arm, which may increase the shooter's comfort and/or the accuracy of the shooter's shots. The saddle device 112 (e.g., the portion of the saddle device 112 that may contact the shooter's arm) may include any suitable ergonomic padding material or combination of materials, such as foam, leather, rubber, plastic, polymers, et cetera. In embodiments, the saddle device may extend along the length of the brace 100. In embodiments, the firearm brace 100 may have the saddle device 112 in lieu of the slots 110; in other embodiments, both the saddle device 110 and the fastening slots 110 may be provided.

The artisan will appreciate that the firearm brace 100 may be used both with left handed shooters and with right handed shooters. Further, it is to be understood that the firearm brace 100 may be constructed to reasonably withstand the effects of shooting the attached firearm and/or other environmental conditions, such as general wear and tear from use. For example, some or all of the components of the firearm brace 100 may be constructed of a suitable material or combination of materials, such as plastic, metal, fiberglass, composites, et cetera.

Figure 3:
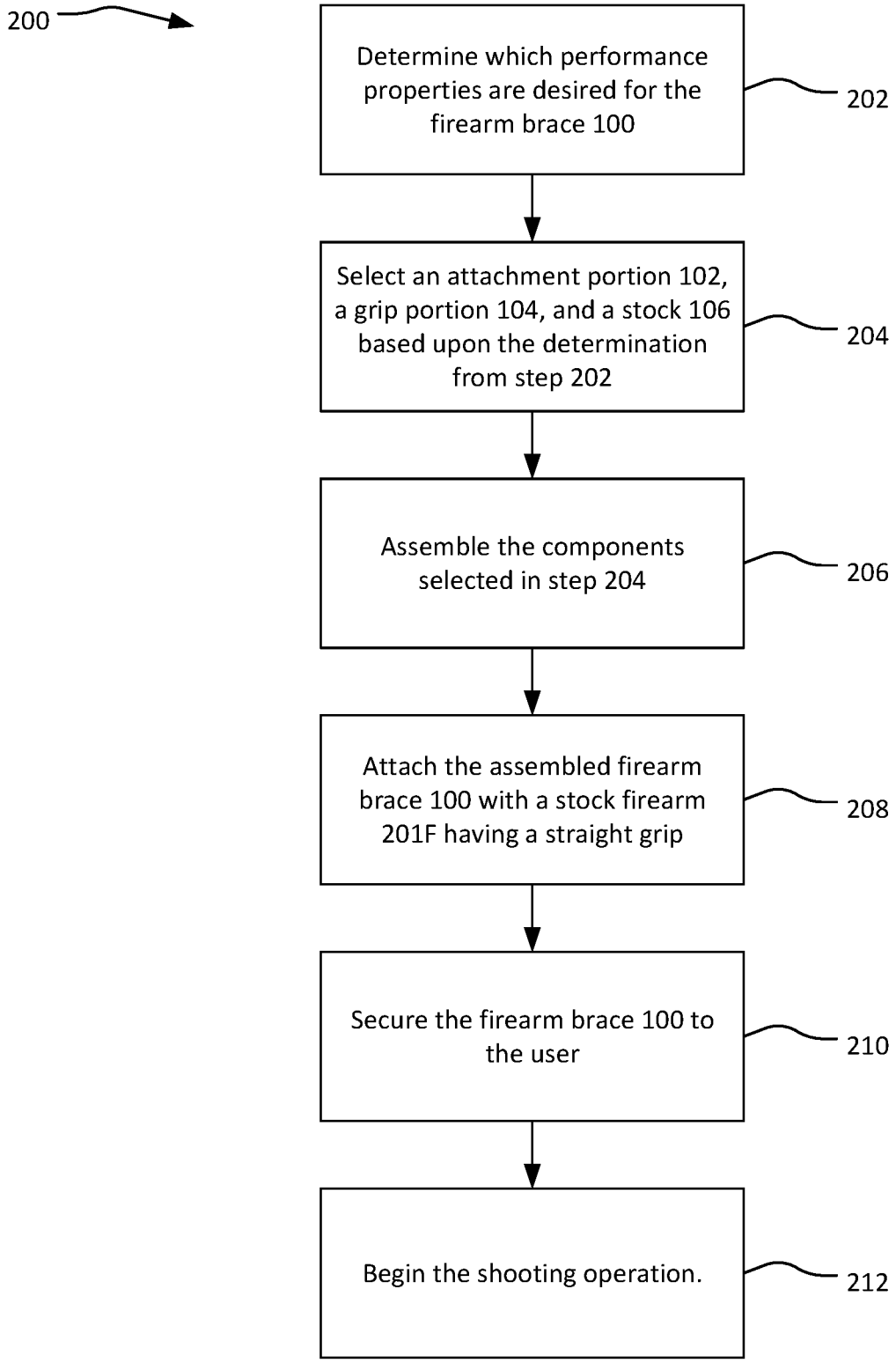
FIG. 3 is a flowchart depicting a method of operating the firearm brace of FIG. 1.

FIG. 3 shows a flowchart depicting a method 200 of operating a modular embodiment of the firearm brace 100. First, at step 202, the user determines which performance properties they desire from the firearm brace 100. For example, the user may desire to use a lightweight, ergonomic straight grip firearm brace 100 with a stock firearm 201F (e.g., a commercially available, usable firearm) having a straight grip. Then, at step 204, the user may select the attachment portion 102, the grip portion 104, and the brace 106 based upon the determination from step 202. In this instance, the user may select a grip portion 104 that has grip grooves 104G, a brace 106 that is configured to be lightweight, and an attachment portion 102 that is compatible with the firearm 201F. Then, at step 206, the user may assemble the firearm brace 100 by removably coupling the selected attachment portion 102, grip portion 104, and brace 106 as described above. Next, at step 208, the user may attach the assembled firearm brace 100 to the firearm 201F. Then, at step 210, the user may further secure the firearm brace 100 to the user. For example, the user may utilize the slots 110 and straps to secure the firearm brace 100 to the user's arm, the user may seat the saddle device 112 on the user's arm, et cetera. Finally, at step 212, the user may begin a shooting operation with the firearm and firearm brace 100.

It is to be understood that the method 200 may have steps added, omitted, and/or modified. For example, the step of securing the firearm brace 100 to the user (step 210) may be omitted where the firearm brace 100 has no such securing structure. As another example, there may be applications where a user may desire to swap out only some of the firearm brace 100 (e.g., just the brace 106). In such a case, the method 200 may be modified to include the steps of detaching the old brace 106 and selecting a new brace 106 to assemble with the rest of the firearm brace 100.

Figure 4:
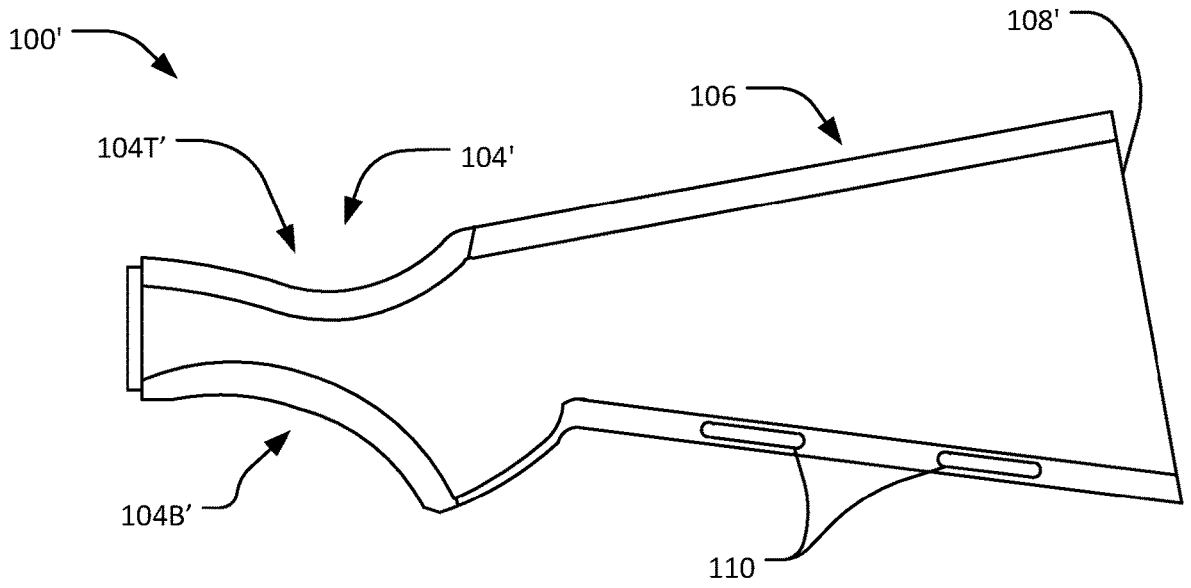
FIG. 4 is a side view of another embodiment of the firearm brace of FIG. 1.

FIG. 4 shows another embodiment 100' of the brace 100. The brace 100' may be generally similar or identical to the brace 100, except as specifically noted and/or shown, or as would be inherent. The same numbers may be used to show the corresponding parts, though with any noted deviations.

A key difference between the brace 100 and the brace 100' may be that the brace 100' may be devoid of the attachment structure 107 for coupling a grip area 104' to a brace 106', as discussed above for brace 100. Rather, the grip area 104' and the brace 106' may be of unitary construction. The brace 100' may also be devoid of the container portion or pocket 109, and of the grooves 104G in the grip portion. The brace 100' may, however, include fastening slots 110 and/or, in embodiments, a saddle. The firearm brace 100, like the firearm brace 100', may be configured for firearms having a straight grip. The firearm brace 100' may, in embodiments, be cheaper to manufacture as compared to the firearm brace 100.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

The disclosure claimed is:

1. A brace for modifying a stock firearm having a straight grip, said brace comprising:

an attachment portion configured for the attachment of the brace to the stock firearm;

a grip portion disposed behind the attachment portion; the grip portion having a top surface and a bottom surface; each of said bottom surface and said top surface being arced; said bottom surface being configured to be held by a shooter during a shooting operation; and a bracing portion disposed behind the attachment portion; the bracing portion having a stock with one or more slots and a saddle; each of said one or more slots extending from a first side of said stock to a second side of said stock in a direction that is transverse to a length of said stock; said saddle extending through said one or more slots and being configured to wrap at least partially around a circumference of a forearm of said shooter to allow for securement of said brace to said forearm of said shooter while said stock firearm is attached to said attachment portion.

2. The brace of claim 1, wherein said grip portion is removably coupled to said bracing portion.

3. The brace of claim 1, wherein said grip portion is configured to be selectively coupled to any one of a plurality of bracing portions.

4. The brace of claim 1, wherein said bottom surface of said grip portion comprises grip grooves.

5. The brace of claim 1, wherein said bracing portion comprises a pouch configured to carry ammunition for said stock firearm; said pouch being attached to an outer surface of said stock.

6. The brace of claim 1, further comprising a removable coupling device configured to be removably coupled to said attachment portion to allow the attachment portion to be secured to a second stock firearm, said second stock firearm and said stock firearm being different types of firearms.

7. A method for modifying a stock firearm with a brace, said method comprising:

providing a brace; said brace comprising:

an attachment portion configured for the attachment of the brace to the stock firearm;

a grip portion disposed behind the attachment portion; the grip portion having a top surface and a bottom surface; each of said bottom surface and said top surface being arced; said bottom surface being configured to be held by a shooter during a shooting operation; and a bracing portion disposed behind the attachment portion; the bracing portion having a stock with one or more slots and a saddle; each of said one or more slots extending from a first side of said stock to a second side of said stock in a direction that is transverse to a length of said stock; said saddle extending through said one or more slots and being configured to wrap at least partially around a circumference of a forearm of said shooter to allow for securement of said brace to said forearm of said shooter while said stock firearm is attached to said attachment portion;

removably securing said attachment portion to said stock firearm.

8. The method of claim 7, further comprising providing grooves in said bottom surface.

9. The method of claim 7, further comprising removably coupling said grip portion to said bracing portion.

10. The method of claim 7, further comprising providing a pouch for carrying ammunition for said stock firearm on said bracing portion; said pouch being attached to an outer surface of said stock.

11. A brace for modifying a firearm having a straight grip, said brace comprising:

an attachment portion configured for the attachment of the brace to the firearm;

a grip portion disposed behind the attachment portion; the grip portion having a top surface and a bottom surface; each of said bottom surface and said top surface being arced; said bottom surface being configured to be held by a shooter during a shooting operation; and a bracing portion disposed behind the attachment portion; the bracing portion having a stock with one or more slots and a saddle; each of said one or more slots extending entirely through said stock in a direction that is transverse to a length of said stock; said saddle extending through said one or more slots and being configured to wrap at least partially around a circumference of a forearm of said shooter to allow for securement of said brace to said forearm of said shooter while said firearm is attached to said attachment portion.

12. The brace of claim 11, wherein said grip portion is removably coupled to said bracing portion.

13. The brace of claim 11, wherein said grip portion is configured to be selectively coupled to any one of a plurality of bracing portions.

14. The brace of claim 11, wherein said bottom surface of said grip portion comprises grip grooves.

15. The brace of claim 11, wherein said bracing portion comprises a pouch configured to carry ammunition for said stock firearm; said pouch being attached to an outer surface of said stock.

16. The brace of claim 11, further comprising a removable coupling device configured to be removably coupled to said attachment portion to allow the attachment portion to be secured to a second firearm, said second firearm and said firearm being different types of firearms.

* * * * *